US008169387B2

(12) United States Patent
Mittal et al.

(10) Patent No.: US 8,169,387 B2
(45) Date of Patent: May 1, 2012

(54) PROGRAMMABLE LED DRIVER

(75) Inventors: Rohit Mittal, Sunnyvale, CA (US); Donato Montanari, Central (HK)

(73) Assignee: IXYS Corporation, Milpitas, CA (US)

( * ) Notice: Subject to any disclaimer, the term of this patent is extended or adjusted under 35 U.S.C. 154(b) by 926 days.

(21) Appl. No.: 11/855,904

(22) Filed: Sep. 14, 2007

(65) Prior Publication Data

US 2009/0073096 A1 Mar. 19, 2009

(51) Int. Cl.
*G09G 3/32* (2006.01)

(52) U.S. Cl. ..... 345/82

(58) Field of Classification Search ..... 345/102, 345/87, 84, 55, 30, 44, 46, 82, 83, 204
See application file for complete search history.

(56) References Cited

U.S. PATENT DOCUMENTS 5,337,284 A 8/1994 Cordoba et al.
6,262,698 B1 * 7/2001 Blum ..... 345/55
6,980,045 B1 * 12/2005 Liu ..... 327/536
6,980,181 B2 * 12/2005 Sudo ..... 345/82
7,724,220 B2 * 5/2010 Yen et al. ..... 345/83
2005/0140428 A1 6/2005 Tran et al.
2006/0256050 A1 * 11/2006 Ikeda ..... 345/82
2007/0008255 A1 * 1/2007 Emek et al. ..... 345/82
2007/0046143 A1 3/2007 Blandino et al.

OTHER PUBLICATIONS

PCT International Search Report and Written Opinion, PCT Application No. PCT/US2008/075627, Nov. 18, 2008.

* cited by examiner

*Primary Examiner* — Richard Hjerpe
*Assistant Examiner* — Jeffrey A Parker
(74) *Attorney, Agent, or Firm* — Kilpatrick Townsend & Stockton LLP

(57) ABSTRACT

An LED driver includes an embedded non-volatile memory (NVM) capable of being programmed and storing control data for setting a variety of features of the LED driver, such as the maximum current for driving the LEDs, analog parameters such as the resistance of the internal resistor for setting the reference current for the LEDs, and the operation modes of the charge pump of the LED driver. This enables implementation of multiple LED driver product options without the need for different metallization steps during the fabrication process for the LED driver.

18 Claims, 4 Drawing Sheets

PROGRAMMABLE LED DRIVER

BACKGROUND OF THE INVENTION

1. Field of the Invention

The present invention relates to an LED (Light-Emitting Diode) driver, and more specifically to a programmable LED driver with an embedded non-volatile memory storing control data for custom programming of a variety of features of the LED driver.

2. Description of the Related Arts

White LEDs are being used increasingly in display devices. For example, some modern liquid crystal display (LCD) devices use white LEDs as the backlight for the LCD display. These LEDs are typically driven by an LED driver. White LED drivers are typically constant current devices where a constant sink current is fed through the white LEDs to provide a constant luminescence. The anode of the white LEDs is driven by a charge pump circuit.

FIG. 1 illustrates a conventional LED driver 100 driving LEDs 112, 114. For example, the LEDs 112, 114 can be white LEDs. The LED driver 100 includes 2 main circuit blocks, a charge pump 102 and a current regulator 110. The charge pump 102 typically converts a battery voltage ($V_{IN}$) into an output voltage ($V_{OUT}$) coupled to the anodes of the LEDs 112, 114. The output voltage ($V_{OUT}$) drives the LEDs 112, 114.

Current through the LEDs 112, 114 sets their intensity and associated luminescence. Thus, in order to obtain accurate intensity, which is very important for displays, the current through the LEDs 112, 114 must be set accurately. Typically, the current regulator 110 is responsible for driving the LEDs with constant current. The current regulator 110 includes, among other components, a bandgap voltage generator 104, an error amplifier comprised of the amplifier 106 and the transistor 119, a current mirror 108 comprised of transistors 116, 118, and LED drive transistors 122, 124, 126.

The bandgap voltage generator 104 generates a bandgap voltage Vref, and the error amplifier (106, 119) ensures that the voltage at node 121 across the resistor $R_{EXT}$ 120 is set at Vref. Typically, the resistor $R_{EXT}$ 120 is external to the LED driver circuit 100. The reference current $I_{REF}$ through the external resistor $R_{EXT}$ 120 is set by the bandgap voltage Vref and the external resistor $R_{EXT}$ 120. That is, the reference current $I_{REF}$ is set by Vref/$R_{EXT}$. The reference current $I_{REF}$ is repeated through the transistor 122 by the current mirror 108, and eventually drives the LEDs 112, 114 by the transistors 122, 124 and the transistors 122, 126, respectively. The size (W/L ratio, or width/length ratio) of the transistors 124, 126 relative to the size of the transistor 122 determines how large the current $I_{D1}$, $I_{D2}$ through the LEDs 112, 114 is relative to the reference current $I_{REF}$ through the transistor 122. Thus, the current $I_{D1}$, $I_{D2}$ through the LEDs 112, 114 is also determined by the bandgap voltage Vref and the external resistor $R_{EXT}$ 120. The resistance $R_{EXT}$ of the external resistor 120 needs to be set accurately in order to control the luminescence of the LEDs 112, 114 precisely. In conventional LED drivers 100, there is no convenient way to change the current through the LEDs 112, 114 without changing the resistance value of the resistor 120.

Typical LED drivers 100 may use an external resistor 120 to set the current in the LEDs 112, 114. Such external resistor 120 adds a pin to the LED driver IC (integrated circuit), extra board space for the overall LED driver circuitry, and results in an increase in the Bill-of-Materials (BOM) cost for the overall LED driver circuitry. Note that different applications might require different maximum currents from the LED driver 100. This is because different LEDs 112, 114 from different manufacturers may give different intensity for different current values. With a conventional LED driver 100, the only way to control the reference current $I_{REF}$ is to change the resistance value of the external resistor 120 so that the current through the LEDs 112, 114 change accordingly. The resistor 120 is typically external to the LED driver 100 in order to have its resistance value changed, which results in waste of a pin, board space, and cost, as explained above.

The charge pump 102 typically operates in multiple operation modes. Initially at power up of the LED driver 100, the input voltage $V_{IN}$ is attached to the output voltage $V_{OUT}$ via the charge pump 102 so that $V_{IN}$ equals $V_{OUT}$. This mode is often called the 1× mode. The charge pump 102 typically changes operation modes as time goes by and the battery voltage $V_{IN}$ drops over time, because the LEDs 112, 114 typically have a voltage drop. The typical voltage drop $V_{LED}$ in a white LED may be, for example, 3.4 V.

As the input voltage $V_{IN}$ decreases over the lifetime of the battery (not shown), the output voltage $V_{OUT}$ decreases in the same proportion since $V_{IN}$ equals $V_{OUT}$ when the charge pump is in 1× mode. Thus, the voltage at nodes 115, 117 (the LED driver pins) is given by $V_{OUT}-V_{LED}$. When the voltage at nodes 115, 117 becomes too low, typically 200 mV, the current regulator 110 goes out of saturation and can no longer provide an accurate current through the LEDs 112, 114. This causes the charge pump 102 to switch to a higher operation mode, typically a 1.5× mode that generates the output voltage $V_{OUT}$ to be $1.5\times V_{IN}$. As a result, the LED driver pin voltage at nodes 115, 117 rises high enough to push the current regulator 110 back into saturation. This process is repeated, and when the battery voltage $V_{IN}$ further decreases to cause the current regulator 110 to go out of saturation even under 1.5× mode, the charge pump switches to 2× mode that generates the output voltage $V_{OUT}$ to be $2\times V_{IN}$.

Although the charge pump 102 may automatically switch to different operation modes as explained above, some LED applications may need to set the operation mode of the charge pump 102 to a single operation mode or have only selected ones of multiple operation modes, even when the charge pump 102 itself has circuitry to operate in multiple operation modes. In order to set the operation mode of the charge pump 102 in a conventional LED driver 100, fixed circuitry has to be used in the charge pump 102 to permanently set the operation mode, which essentially requires manufacturing different LED driver integrated circuits using different metallization processes during the fabrication process of the LED driver IC.

Therefore, there is a need for a more convenient technique to change the maximum current through the LEDs. There is also a need for a technique to bring the resistor for generating the reference current internal to the LED driver and be able to trim the resistor. Finally, there is a need for a more convenient technique to set the operation mode of the charge pump of the LED driver.

SUMMARY OF THE INVENTION

Embodiments of the present invention include an LED driver with an embedded non-volatile memory (NVM) capable of being programmed and storing control data for setting a variety of features of the LED driver, such as but not limited to the maximum current for driving the LEDs, analog parameters such as the resistance of the internal resistor for setting the reference current for the LEDs, and operation modes of the charge pump of the LED driver. This enables the implementation of multiple LED driver product options without the need for different metallization steps during the fabrication process for the LED driver.

In one embodiment, a programmable LED driver for driving one or more LEDs comprises a charge pump configured to operate in one or more operation modes for receiving an input voltage and generating an output voltage to be applied to said one or more LEDs, a current regulator for generating a reference current, and a non-volatile memory module storing first control data, where current through the one or more LEDs is determined based on the reference current and the first control data.

In another embodiment, the current regulator includes a trimmable resistor internal to the programmable LED driver, and the reference current is generated based upon a reference voltage and the resistance of the trimmable resistor. The non-volatile memory further stores second control data, and the resistance of the trimmable resistor is adjusted based upon the second control data.

In still another embodiment, the charge pump is configured to operate in one or more of a plurality of operation modes, where each operation mode is configured to generate a different output voltage based on the input voltage. The non-volatile memory further stores third control data, and the one or more of the plurality of operation modes are activated or inactivated based upon the third control data.

The present invention has the advantage that a variety of features of the LED driver, such as the LED current, internal resistance for setting the reference current for the LEDs, and the operation modes of the charge pump, and potentially a variety of other analog parameters of the LED driver may be conveniently set simply by programming the LED driver with the appropriate control data value in the non-volatile memory. Thus, an LED driver with different functionalities and features can be implemented as a single IC from the same die in the semiconductor fabrication process without having to go through different metallization processes for the different functionalities during the fabrication of the IC for the LED driver.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

The Figures (FIG.) and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 2:
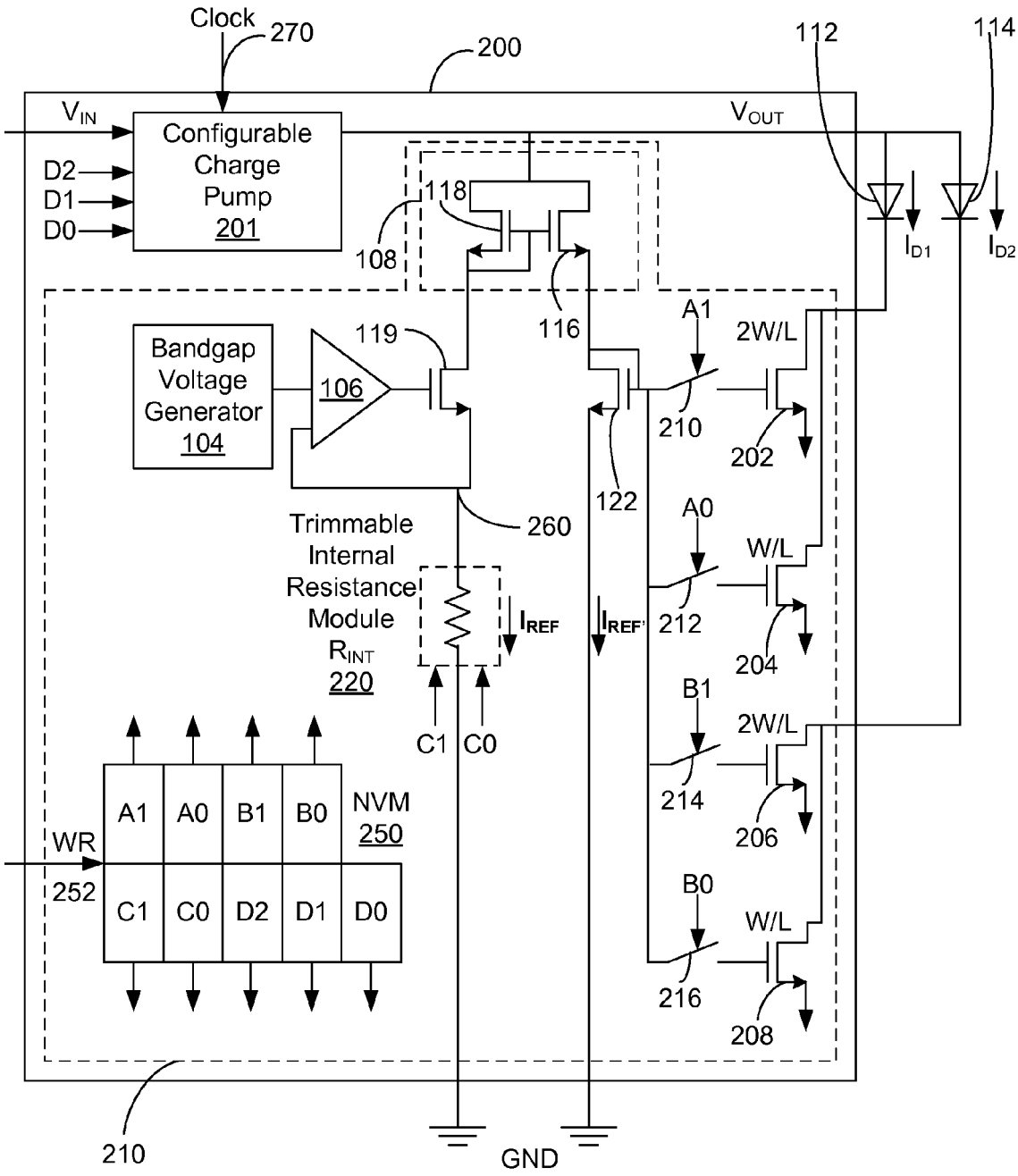
FIG. 2 illustrates an LED driver for driving LEDs, according to one embodiment of the present invention.

FIG. 2 illustrates an LED driver 200 for driving LEDs 112, 114, according to one embodiment of the present invention. For example, the LEDs 112, 114 can be white LEDs. The LED driver 200 includes 2 main circuit blocks, a configurable charge pump 201 and a current regulator 210.

Current through the LEDs 112, 114 sets their intensity and associated luminescence. The current regulator is responsible for driving the LEDs 112, 114 with constant current. The current regulator includes, among other components, a bandgap voltage generator 104, an error amplifier comprised of the amplifier 106 and the transistor 119, a current mirror 108 comprised of transistors 116, 118, a non-volatile memory (NVM) 250, and LED drive transistors 122, 202, 204, 206, 208. Although the NVM 250 is shown in FIG. 2 as part of the current regulator, the NVM 250 may be part of, or separate from, the current regulator.

The NVM 250 stores control data for controlling the operation of various features of the LED driver 200. For example, the NVM 250 stores control data A1, A0, B1, B0 for controlling the current through the LEDs 112, 114, control data C1, C0 for trimming the internal resistance $R_{INT}$ 220, and control data D2, D1, D0 for setting the operation mode of the charge pump 201, as will be explained in more detail below. The control data A1, A0, B1, B0, C1, C0, D2, D1, D0 stored in the NVM 250 may be 1-bit digital data, although they may be in other form of data. Such control data may be written into the NVM 250 via the write (WR) line 252 through, for example, an external computer (not shown). The data written into the NVM 250 are not deleted even when the NVM 250 is powered off. The NVM 250 can be a flash memory, an SRAM (Synchronous Random Access Memory), or any other type of non-volatile memory.

Figure 1:
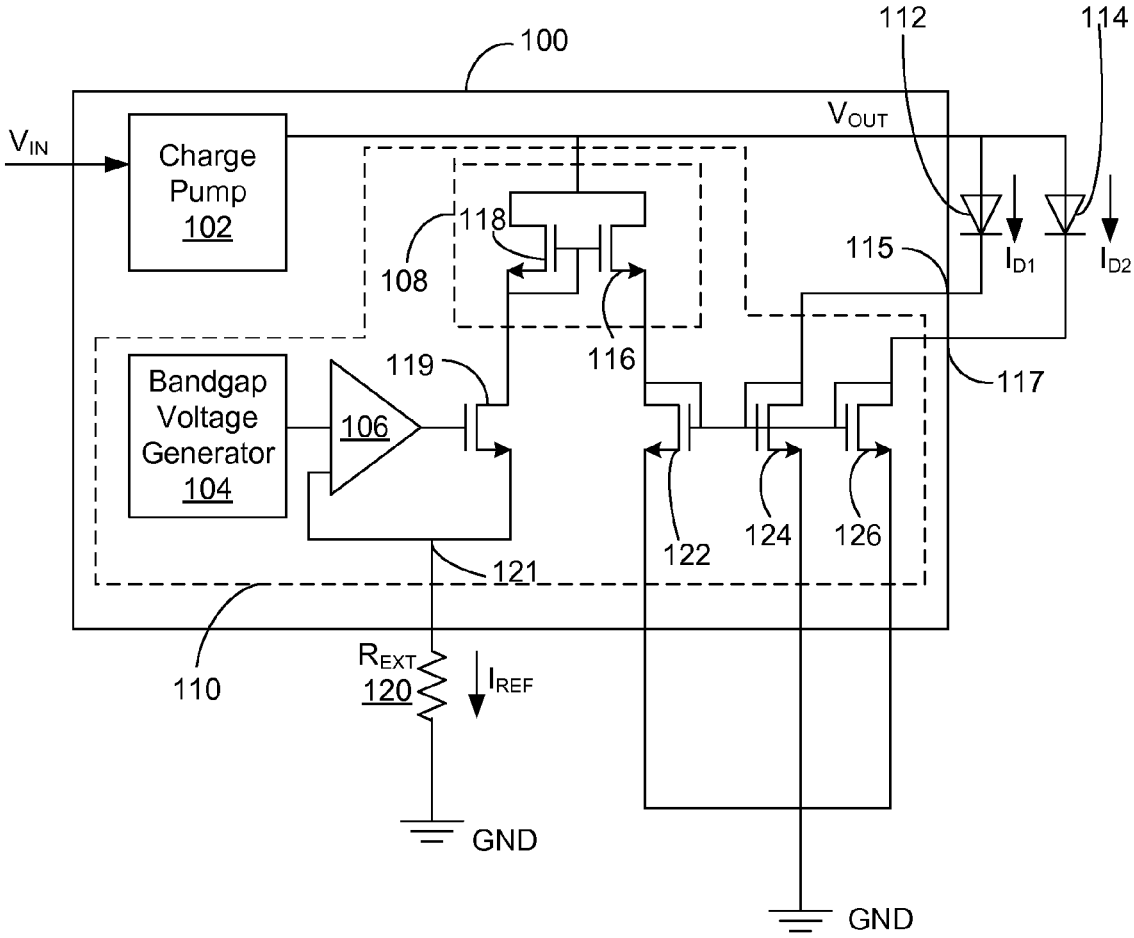
FIG. 1 (PRIOR ART)
FIG. 1 illustrates a conventional LED driver for driving LEDs.

The bandgap voltage generator 104 generates a bandgap voltage Vref, and the error amplifier (106, 119) ensures that the voltage at node 260 across the resistor $R_{INT}$ 220 is set at Vref. Note that the resistor 220 is internal to the LED driver 200, contrary to the external resistor 120 for use with the conventional LED driver 100 of FIG. 1. The reference current $I_{REF}$ through the internal resistor $R_{INT}$ 220 is set by the bandgap voltage Vref and the internal resistance $R_{INT}$ 220. That is, the reference current $I_{REF}$ is set by Vref/$R_{INT}$. The reference current $I_{REF}$ is repeated through the transistor 122 as current $I_{REF}'$ by the current mirror 108, and eventually drives the LEDs 112, 114 by the transistors 202, 204 and transistors 206, 208, respectively.

The current $I_{REF}'$ through the transistor 116 may be identical to or different from the reference current $I_{REF}$ through the transistor 118, depending upon the relative size or width/length (W/L) ratio of the transistor 116 compared to that of the transistor 118. In addition, the current $I_{REF}'$ through the transistor 116 is repeated through the transistors 202, 204, 206, 208, according to their relative size or W/L ratio compared to that of the transistor 122.

Note that the transistor 202 has a size or a width/length (W/L) ratio that is twice the W/L ratio of the transistor 204, and the transistor 206 has a size or W/L ratio that is twice the W/L ratio of the transistor 208. Thus, the transistor 202 draws twice as much the current drawn by the transistor 204, both of which are added to drive the LED 112. Likewise, the transistor 206 draws twice as much the current drawn by the transistor 208, both of which are added to drive the LED 114.

The control data A1, A0 stored in the NVM 250 determine the maximum current through the LED 112, and the control data B1, B0 stored in the NVM 250 determine the maximum current through the LED 114. Specifically, the control data A1, A0 control the on/off state of the switches 210, 212, respectively. For example, the switches 210, 212 may be on (closed) when the control data A1, A0 are "1", respectively, and off (open) when the control data A1, A0 are "0", respectively. The control data B1, B0 control the on/off state of the switches 214, 216, respectively. For example, the switches 214, 216 may be on (closed) when the control data B1, B0 are "1", respectively, and off (open) when the control data B1, B0 are "0", respectively.

For illustration, assume that the sizes or W/L ratios of all the transistors 118, 116, 122, 204, and 208 are identical, and the W/L ratio of the transistors 202, 206 is twice the W/L ratio of the transistors 204, 208 and that $I_{REF}$ is 1 mA. When A1, A0 are "1" and "1" respectively, the maximum current through the LED 112 is 3 mA because both switches 210, 212 are on. When A1, A0 are "1" and "0" respectively, the maximum current through the LED 112 is 2 mA because the switch 210 is on and the switch 212 is off. When A1, A0 are "0" and "1" respectively, the maximum current through the LED 112 is 1 mA because the switch 210 is off and the switch 212 is on. When A1, A0 are "0" and "0" respectively, the maximum current through the LED 112 is 0 mA because both switches 210, 212 are off. Similarly, when B1, B0 are "1" and "1" respectively, the maximum current through the LED 114 is 3 mA because both switches 214, 216 are on. When B1, B0 are "1" and "0" respectively, the maximum current through the LED 114 is 2 mA because the switch 214 is on and the switch 216 is off. When B1, B0 are "0" and "1" respectively, the maximum current through the LED 114 is 1 mA because the switch 214 is off and the switch 216 is on. When B1, B0 are "0" and "0" respectively, the maximum current through the LED 114 is 0 mA because both switches 214, 216 are off.

The resistance $R_{INT}$ of the internal resistance module 220 needs to be set accurately in order to control the reference current $I_{REF}$ and the luminescence of the LEDs 112, 114 precisely. The use of an internal resistor 220 results in saving a pin of the LED driver IC and cost and board area associated with the additional pin. Since the resistor 220 is brought internal to the LED driver 200 according to the present invention, it should be capable of being trimmed internally and accurately as necessary. Although conventionally it was possible to use a polysilicon fuse to trim the internal resistor 220, that has the disadvantage of increasing overall area and adding to manufacturing costs. Moreover, polysilicon or metal fuses have long term reliability problems due to fuse regrowth concerns.

Figure 3:
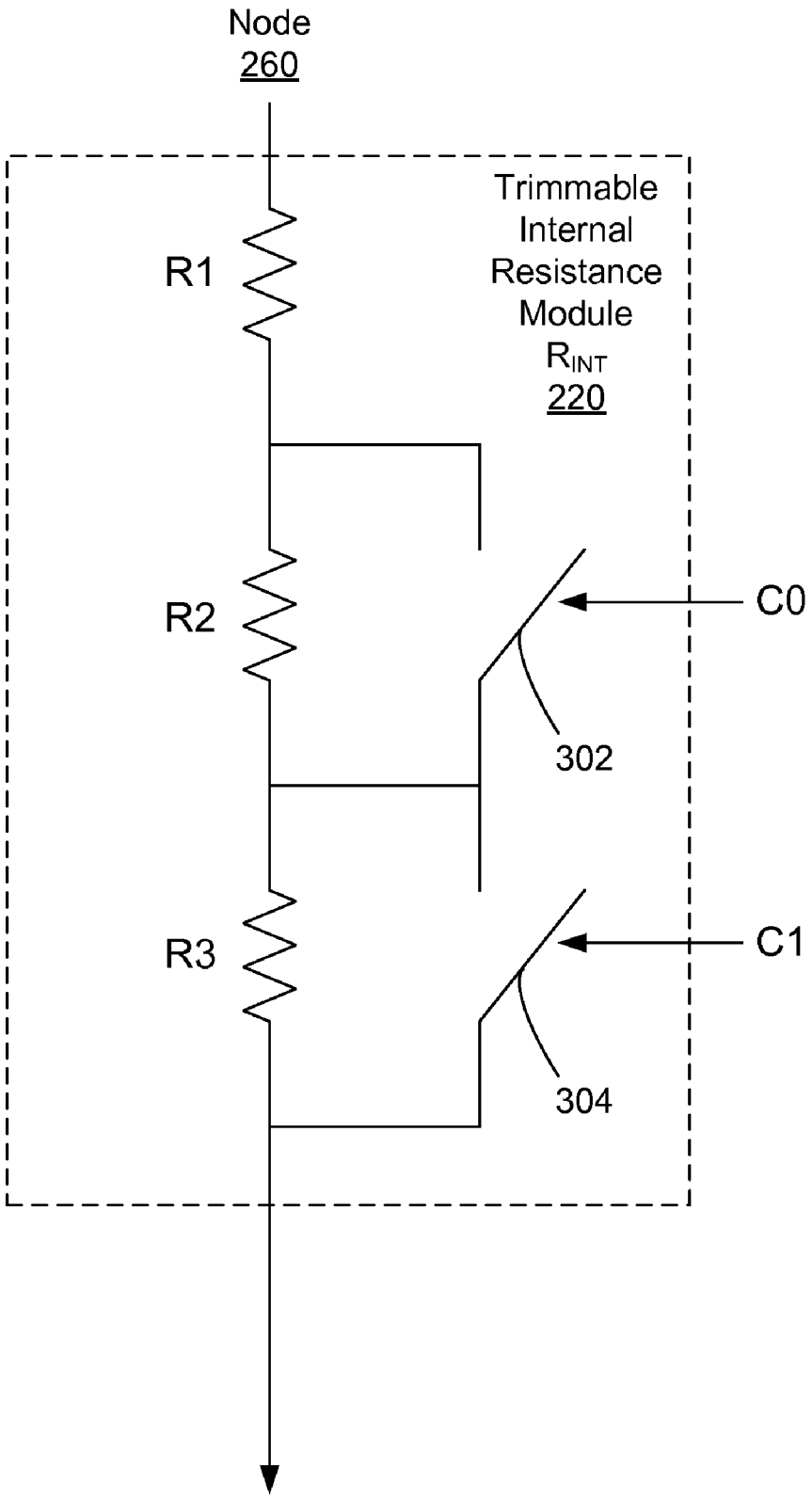
FIG. 3 illustrates using the control data stored in the non-volatile memory (NVM) to trim the internal resistance of the LED driver, according to one embodiment of the present invention.

FIG. 3 illustrates using the control data stored in the NVM 250 to trim the internal resistance module 220, according to one embodiment of the present invention. Referring to both FIGS. 2 and 3, the trimmable internal resistance module 220 of FIG. 2 includes a plurality of resistors connected in series with each other, in this example R1, R2, R3. The resistance module 220 also includes switches 302, 304 that are connected in parallel to resistors R2, R3, respectively.

The switches 302, 304 are turned on (closed) or off (open) in response to the control data C0, C1 of the NVM 250. For example, when the control data C0, C1 are "1", the switches 302 and 304 are turned on (closed), thereby shorting the connected resistors R2, R3, respectively. When the control data C0, C1 are "0", the switches 302 and 304 are turned off (open), and thus the resistors R2 and R3 become connected to R1 in series. In other words, the switches 302, 304 effectively remove or connect the corresponding resistors R2, R3, respectively to the resistor R1.

When C0 is "1" and C1 is "1", the total resistance $R_{INT}$=R1+R2+R3 and $I_{REF}$=Vref/(R1+R2+R3). When C0 is "1" and C1 is "0", the total resistance $R_{INT}$=R1+R2 and $I_{REF}$=Vref/(R1+R2). When C0 is "0" and C1 is "1", the total resistance $R_{INT}$=R1+R3 and $I_{REF}$=Vref/(R1+R3). When C0 is "0" and C1 is "0", the total resistance $R_{INT}$=R1 and $I_{REF}$=Vref/R1. In this manner, the LED driver 120 of the present invention may trim the resistance $R_{INT}$ of the internal resistance module 220 and also set the reference current $I_{REF}$ through the internal resistor 220 and eventually the current through the LEDs 112, 114 accurately without using fuses. The resistance $R_{INT}$ of the internal resistance module 220 and also set the reference current $I_{REF}$ through the internal resistor 220 are programmable simply by programming appropriate control data C1, C2 of the NVM 250 that is internal to the LED driver 200 IC.

Figure 4:
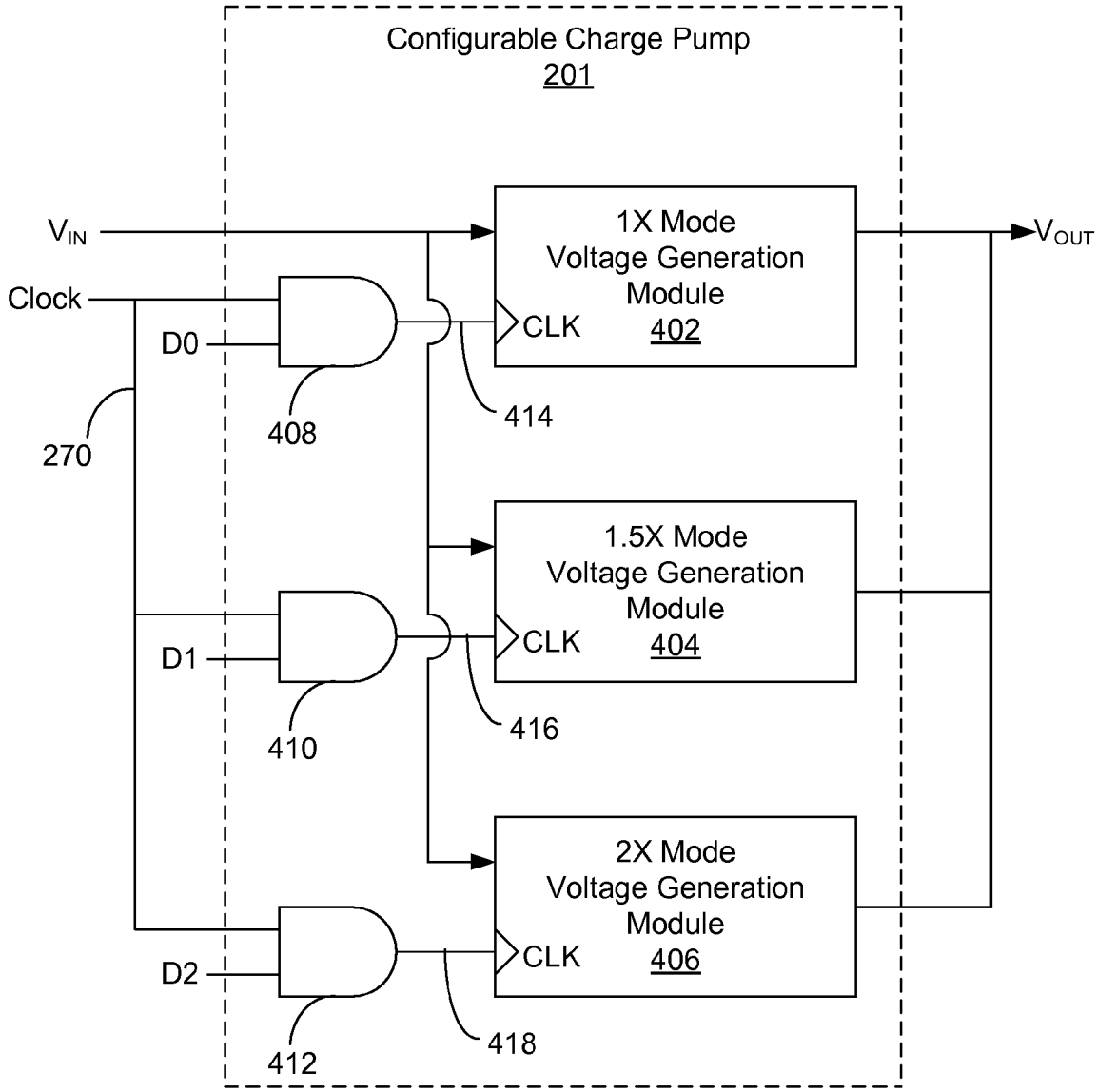
FIG. 4 illustrates the charge pump of FIG. 2 that is configurable using the control data stored in the NVM, according to one embodiment of the present invention.

FIG. 4 illustrates the charge pump 201 of FIG. 2 that is configurable using the control data stored in the NVM 250, according to one embodiment of the present invention. The configurable charge pump 201 converts a battery voltage ($V_{IN}$) into an output voltage ($V_{OUT}$) in one of the plurality of operation modes, a 1× mode, 1.5× mode, and 2× mode. The charge pump 201 includes a 1× mode voltage generation module 402, a 1.5× mode voltage generation module 404, and a 2× mode generation module 406. The 1× mode voltage generation module 402 receives the battery input voltage $V_{IN}$ and generates an output voltage $V_{OUT}$ where $V_{OUT}=V_{IN}$. The 1× mode voltage generation module 402 requires a running clock signal (Clock) coupled to its CLK input in order to operate and generate the output voltage $V_{OUT}$. The 1.5× mode voltage generation module 404 receives the battery input voltage $V_{IN}$ and generates an output voltage $V_{OUT}$ where $V_{OUT}=1.5\times V_{IN}$. The 1.5× mode voltage generation module 404 also requires a running clock signal (Clock) coupled to its CLK input in order to operate and generate the output voltage $V_{OUT}$. The 2× mode voltage generation module 406 receives the battery input voltage $V_{IN}$ and generates an output voltage $V_{OUT}$ where $V_{OUT}=2\times V_{IN}$. The 2× mode voltage generation module 406 also requires a running clock signal (Clock) coupled to its CLK input in order to operate and generate the output voltage $V_{OUT}$. The output voltage ($V_{OUT}$) of the charge pump 201 drives the LEDs 112, 114. The internal circuitry itself of the 1× mode voltage generation module 402, 1.5× mode voltage generation module 404, and 2× mode voltage generation module 406 are conventional and known in the art, and is not the subject of the invention disclosed herein.

A typical charge pump has 3 modes of operation as explained above, 1×, 1.5× and 2×. However, some LED applications may only need 1 mode of operation (1×) in the charge pump, in which case the charge pump 201 behaves as a low voltage dropout regulator. In other LED applications, all three operation modes may be needed in the charge pump 201 because the battery input voltage $V_{IN}$ can drop low enough and the voltage drop $V_{LED}$ across the LEDs 112, 114 can be high enough. Thus, it would be very useful to activate or inactivate one or more of the 1× mode voltage generation module 402, 1.5× mode voltage generation module 404, 2× mode voltage generation module 406 in a convenient way.

The control data D0, D1, D2 of the NVM 250 determines which one(s) of the 1× mode voltage generation module 402, 1.5× mode voltage generation module 404, 2× mode voltage generation module 406 becomes active. As shown in FIG. 4, the control data D0, D1, D2 are input to the AND gates 408, 410, 412, respectively, to be AND'ed with the clock signal 270. Thus, when D0=1, the signal 414 to the CLK input of the 1× mode voltage generation module 402 is the same as the clock signal 270 and thus the 1× mode voltage generation module 402 is active. But when D0=0, the signal 414 to the CLK input of the 1× mode voltage generation module 402 is inactive and thus the 1× mode voltage generation module 402 is inactive. When D1=1, the signal 416 to the CLK input of the 1.5× mode voltage generation module 404 is the same as the clock signal 270 and thus the 1.5× mode voltage generation module 404 is active. But when D1=0, the signal 416 to the CLK input of the 1.5× mode voltage generation module 404 is inactive and thus the 1.5× mode voltage generation module 404 is inactive. When D2=1, the signal 418 to the CLK input of the 2× mode voltage generation module 406 is the same as the clock signal 270 and thus the 2× mode voltage generation module 406 is active. But when D2=0, the signal 418 to the CLK input of the 2× mode voltage generation module 406 is inactive and thus the 2× mode voltage generation module 406 is inactive.

Therefore, activating or inactivating one or more of the operation modes of the charge pump 201 can be accomplished simply by programming the control data D0, D1, D2 of the NVM 250. If D0=1 but D1=0 and D2=0, the charge pump 201 is a single mode (1×) charge pump. However, if D0=D1=D2=1, the charge pump 201 becomes a tri-mode charge pump. Thus, there is no need to make 2 separate LED drivers with different mode charge pumps.

The present invention has the advantage that a variety of features, such as the LED current, internal resistance for setting the reference current for the LEDs, and the operation modes of the charge pump, may be conveniently set simply by programming the LED driver with the appropriate control data value in the NVM. Thus, an LED driver with different functionalities and features can be implemented as a single IC from the same die in the semiconductor fabrication process.

Upon reading this disclosure, those of skill in the art will appreciate still additional alternative structural and functional designs for a programmable LED driver. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. A programmable light-emitting diode (LED) driver circuit for driving at least one LED, the programmable LED driver circuit comprising:

a charge pump capable of being turned off and on, and when on, capable of providing a plurality of different non-zero output voltages to the at least one LED in response to first control signal;

a current regulator for generating a reference current, the current regulator including an on-chip trimmable resistance module, the reference current being generated based upon a reference voltage and a resistance of the on-chip trimmable resistance module;

the on-chip trimmable resistance module including a plurality of resistors connected in series and a plurality of switches coupled to receive second control signals to thereby change the resistance of the on-chip trimmable resistance module;

at least two transistors coupled to each of the at least one LED, the at least two transistors being controlled by third control signals; and a non-volatile memory configured to store:

first control data for specifying the first control signals to select one of the different non-zero output voltages;

second control data for specifying the second control signals to select the resistance of the on-chip trimmable resistance module;

third control data for specifying the third control signals to operate the at least two transistors.

2. The programmable LED driver of claim 1, wherein:

the current regulator includes at least a first transistor and a second transistor both for driving one of the LEDs and at least a first switch and a second switch coupling the reference current to the first transistor and the second transistor, respectively, the first transistor having a width to length ratio different from that of the second transistor; and the third control data controls on and off states of the first switch and the second switch to adjust the current through said one of the LEDs.

3. The programmable LED driver of claim 2, wherein the third control data includes a first bit and a second bit controlling the on and off states of the first switch and the, second switch, respectively, to adjust the current though said one of the LEDs.

4. The programmable LED driver of claim 1, wherein the third control data can be programmed externally by writing the third control data to the non-volatile memory from outside the programmable LED driver.

5. The programmable LED driver of claim 1, wherein:

the current regulator includes a trimmable resistor internal to the programmable LED driver, the reference current being generated based upon a reference voltage and a resistance of the trimmable resistor; and the non-volatile memory further stores second control data, the resistance of the trimmable resistor being adjusted based upon the second control data.

6. The programmable LED driver of claim 5, wherein:

the trimmable resistor includes a plurality of resistors connected to each other in series;

one or more switches each coupled to one of the plurality of resistors, each of the switches configured to short the corresponding resistor if said each of the switches is turned on; and the second control data controls on and off states of said one or more switches to adjust the resistance of the trimmable resistor.

7. The programmable LED driver of claim 5, wherein:

the trimmable resistor includes a first resistor, a second resistor, and a third resistor connected to each other in series;

a first switch and a second switch coupled to the second resistor and the third resistor, respectively, and configured to short the second resistor and the third resistor, respectively, if the first switch and the second switch are turned on, respectively; and the second control data includes a first bit and a second bit controlling the on and off states of the first switch and the second switch, respectively, to adjust the resistance of the trimmable resistor.

8. The programmable LED driver of claim 1, wherein:

the charge pump is configured to operate in one or more of a plurality of operation modes each providing, a different output voltage based on the input voltage; and the non-volatile memory further stores first control data, said one or more of the plurality of operation modes being activated or inactivated based upon the first control data.

9. The programmable LED driver of claim 8, wherein the charge pump includes:

a first operation mode voltage generation module, a second operation mode voltage generation module, and a third operation mode voltage generation module each activated responsive to an active clock signal; and a first AND gate, a second AND gate, and a third AND gate each coupled to the first operation mode voltage generation module, the second operation mode voltage generation module, and the third operation mode voltage generation module, respectively, to pass or block the active clock signal based upon the second control data.

10. The programmable LED driver of claim 1, wherein said one or more LEDs are white LEDs and the programmable LED driver is configured to drive the white LEDs.

11. An programmable light-emitting diode (LED) driver circuit disposed on a single integrated circuit for driving at least one LED, the programmable LED driver circuit comprising:

a programmable charge pump having a first input terminal coupled to receive a voltage, at least one second input terminal connected to receive a control signal to select among a plurality of non-zero output voltages, an output terminal connected to an input node of the at least one LED to provide the selected one of the plurality of non-zero output voltages to the at least one LED in response to a first control signal provided to the at least one second input terminal of the charge pump;

a programmable current regulator connected to the output terminal for generating a reference current based upon a reference voltage and a programmable resistance module, the programmable resistance module having a resistance which changes in response to a second set of control signals provided to the programmable resistance module;

a circuit coupled to an output node of the at least one LED, the circuit including at least two programmable transistor-switch pairs for the at least one LED, the transistors in each of the at least two programmable transistor-switch pairs having different sizes, wherein the transistor and the switch are serially connected between an output node of the at least one LED and the programmable current regulator, and wherein the switches are controllable in response to a third set of control signals; and a non-volatile memory storing first control data which specifies the first set of control signals, second control data which specifies the second set of control signals, and third control data which specifies the third set of control signals.

12. The programmable LED driver of claim 11, wherein:

the current regulator includes at least a first transistor and a second transistor both for driving one of the LEDs and at least a first switch and a second switch coupling the reference current to the first transistor and the second transistor, respectively, the first transistor having a width to length ratio different from that of the second transistor; and the third control data controls on and off states of the first switch and the second switch to adjust the current through said one of the LEDs.

13. The programmable LED driver of claim 12, wherein the third control data includes a first bit and a second bit controlling the on and off states of the first switch and the second switch, respectively, to adjust the current through said one of the LEDs.

14. The programmable LED driver of claim 11, wherein the third control data can be programmed by writing the third control data to the non-volatile memory from outside the programmable LED driver.

15. The programmable LED driver of claim 11, wherein:

the trimmable resistance module includes a plurality of resistors connected to each other in series;

switches each coupled to one of the plurality of resistors, each of the switches configured to short the corresponding resistor if said each of the switches is turned on; and the second control data controls on and off states of said one or more switches to adjust the resistance of the trimmable resistor.

16. The programmable LED driver of claim 11, wherein:

the trimmable resistance module includes a first resistor, a second resistor, and a third resistor connected to each other in series;

a first switch and a second switch coupled to the second resistor and the third resistor, respectively, and configured to short the second resistor and the third resistor, respectively, if the first switch and the second switch are turned on, respectively; and the second control data includes a first bit and a second bit controlling the on and off states of the first switch and the second switch, respectively, to adjust the resistance of the trimmable resistance module.

17. The programmable LED driver of claim 11, wherein the charge pump includes:

a first operation mode voltage generation module, a second operation mode voltage generation module, and a third operation mode voltage generation module each activated responsive to an active clock signal; and a first AND gate, a second AND gate, and a third AND gate each coupled to the first operation mode voltage generation module, the second operation mode voltage generation module, and the third operation mode voltage generation module, respectively, to pass or block the active clock signal based upon the first control data.

18. The programmable LED driver of claim 11, wherein said one or more LEDs are white LEDs and the programmable LED driver is configured to drive the white LEDs.

* * * * *